United States Patent [19]

House et al.

[11] 4,267,956

[45] May 19, 1981

[54] LIQUID TIGHT TRAY

[75] Inventors: Richard F. House, St. Charles; Karl A. Kohler, Roselle, both of Ill.; Philip W. Lewis, Greensboro, N.C.

[73] Assignee: Container Corporation of America, Chicago, Ill.

[21] Appl. No.: 115,607

[22] Filed: Jan. 25, 1980

[51] Int. Cl.[3] ..... B65D 5/36

[52] U.S. Cl. ..... 229/30; 229/41 B

[58] Field of Search ..... 229/30, 31, 29 B, 41 B

[56] References Cited

U.S. PATENT DOCUMENTS

| | | | |
|---|---|---|---|
| 2,076,844 | 4/1937 | Holmes | 229/29 B |
| 2,637,482 | 5/1953 | Brodenick | 229/30 |
| 2,749,016 | 6/1956 | Cote | 229/41 B X |
| 2,984,401 | 5/1961 | Henkender | 229/41 B |
| 3,003,678 | 10/1961 | Chase | 229/41 B X |
| 3,659,773 | 5/1972 | Manizza | 229/41 B X |

*Primary Examiner*—Davis T. Moorhead

*Attorney, Agent, or Firm*—Richard W. Carpenter

[57] ABSTRACT

A tray having tab, bottom, side and end walls arranged and disposed so that by pushing inwardly on the end walls, a tray will be formed from a flat tubular structure and the end walls will snap into interlocking engagement with the top wall.

8 Claims, 8 Drawing Figures

LIQUID TIGHT TRAY

SUMMARY OF THE INVENTION

This invention relates to trays and more particularly to liquid tight trays used in hospitals and doctors' offices for holding relatively small quantities of liquid for short periods of time.

It is an important object of the invention to provide a relatively inexpensive tray of the type described which can be readily erected from a collapsed condition with one hand of the person erecting the tray.

Another object of the invention is the provision of a tray formed of a collapsible blank of foldable paperboard and plastic film.

A more specific object of the invention is the provision of a tray having top, bottom, side and end walls arranged and disposed so that by pushing inwardly on the end walls, a tray will be formed from a flat tubular structure and the end walls will snap into interlocking engagement with the top wall.

These and other objects of the invention will be apparent from an examination of the following description and drawings.

THE DRAWINGS

It will be understood that, for purposes of clarity, certain elements may be intentionally omitted from certain views where they are believed to be illustrated to better advantage in other views.

DESCRIPTION OF THE INVENTION

Figure 2:
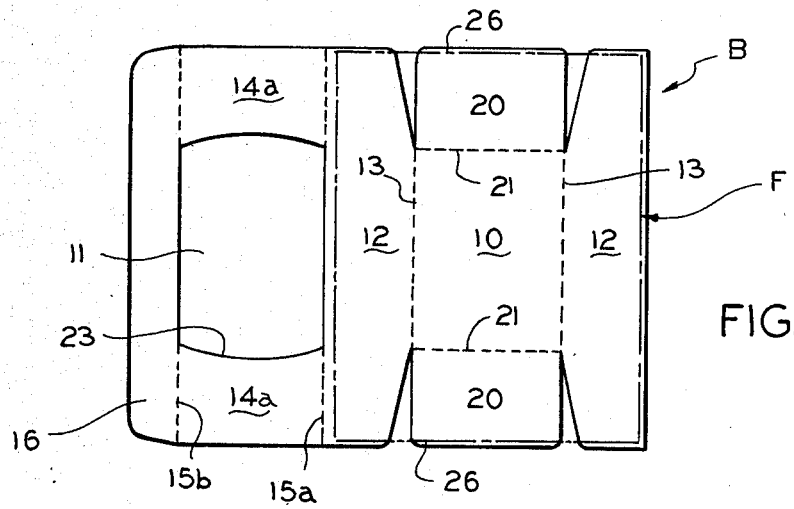
FIG. 2 is a plan view of a blank from which the tray illustrated in FIG. 1 may be formed.
Figure 1:
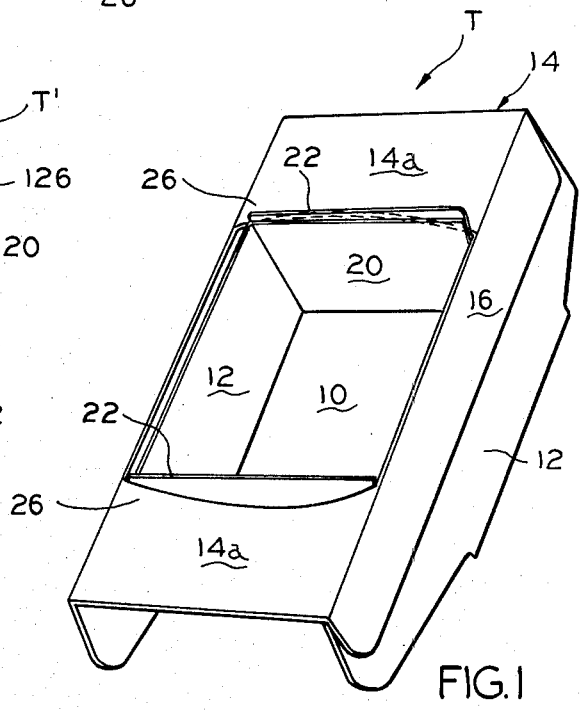
FIG. 1 is a perspective view of one version of a tray embodying features of the invention, as shown in the erected condition.
Figure 8:
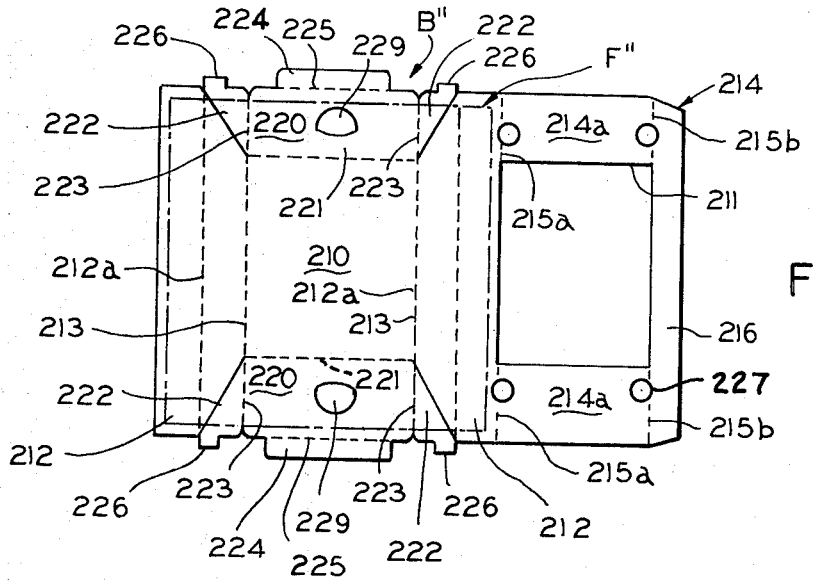
FIG. 8 is a plan view of the blank from which the tray of FIG. 5 may be formed.

Referring now to the drawings for a better understanding of the invention, and particularly to FIGS. 1 and 2, it will be seen that the invention comprises a liquid tight tray, indicated generally at T, which is formed from a unitary blank B of foldable sheet material such as paperboard, having a thin film F of liquid impermeable material attached to and extending over portions thereof.

The tray is adapted to be readily erected with one hand from a collapsed tubular blank so that it can be quickly set up for use in doctors' offices or hospitals.

In the embodiment illustrated in FIG. 1, the tray is of a generally tubular construction and includes a bottom wall 10 and a pair of opposed said walls 12 having their lower edges foldably joined along fold lines 13 to opposed side edges of bottom wall 10 and upstanding therefrom. The tray also includes a top wall 14 having a pair of co-planar end sections **14*a* spaced from each other at opposite ends of the tray to provide therebetween an opening 11 which is substantially co-extensive with the bottom wall 10** of the tray and which affords access to the tray.

One side edge of the top wall 14 is foldably joined along a fold line **15*a* to an upper edge of a related side wall 12, while the other side edge of top wall 14 is foldably joined along a fold line 15*b* to one edge of a glue flap 16 which may be adhesively secured to the other side wall 12 to form a tubular construction. The opposed ends of the tubular construction are closed by a pair of end walls 20 which are foldably joined at their lower edges along fold lines 21 to opposed end edges of bottom wall 10**.

The end walls 20 each have upper portions 26 which serve to engage edges of the respective top wall end sections to lock the tray in erected condition in a manner hereinafter described.

After the blank has been formed with marginal edges of film F attached to the inside surface of the blank by adhesive, as shown in FIG. 2, and after the glue flap 16 has been secured to the related side wall 12, there is provided a tubular construction in collapsed condition.

In order to quickly erect the tray the blank is turned upside down with the bottom wall on top. A person erecting the tray can then grasp the opposed end walls with thumb and fingers and squeeze them together. As this is done the end walls move upwardly to vertical position with the upper portions 26 engaging the inboard edges of the respective top end sections **14*a* in the opening 11** of the tray to lock the tray in erected condition. It will be understood that only the marginal edges of the film F are secured to the end and side walls of the tray and are free from attachment to the bottom wall of the tray to permit the carton to be collapsed and erected in the manner described.

Figure 4:
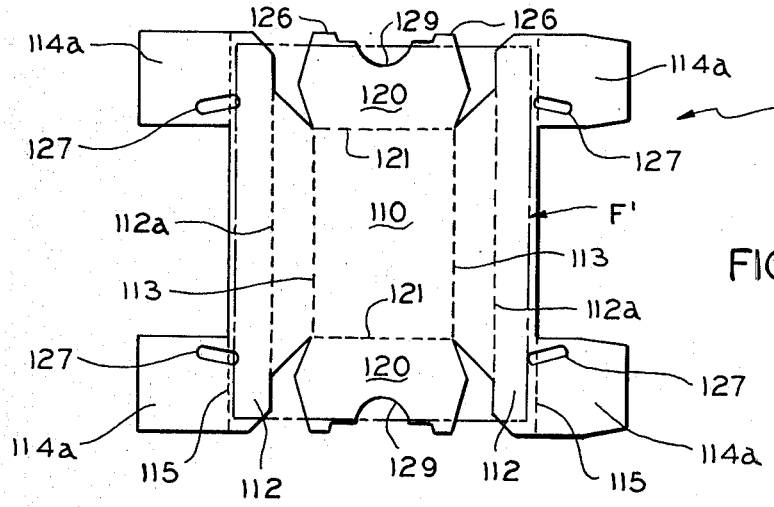
FIGS. 3 and 4 are views similar to FIGS. 1 and 2, but illustrating a modified form of the invention.
Figure 3:
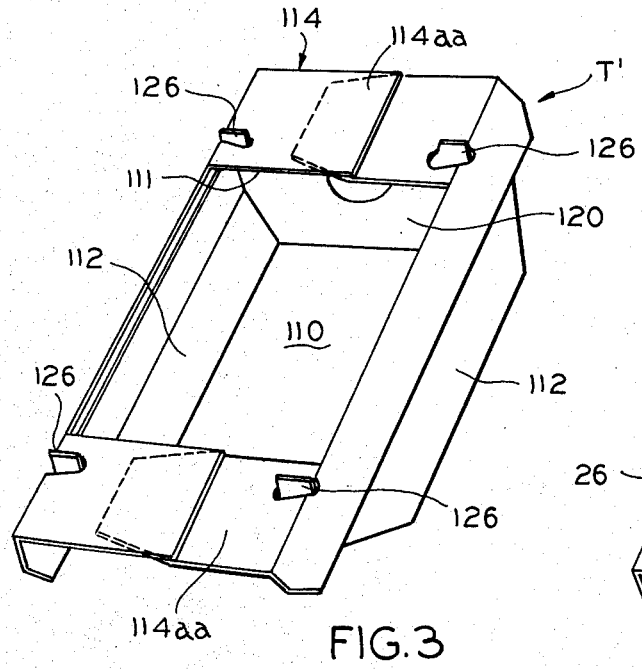

Now referring to FIGS. 3 and 4, it will be seen that a slightly modified form of the invention is disclosed which includes a similar type of tray T' formed from a unitary blank B' of paperboard to which has been attached a sheet of liquid impermeable film F'.

The tray includes a bottom wall 110 having a pair of opposed side walls 112 foldably joined to its opposed side edges along fold lines 113 and upstanding therefrom. The tray also includes a top wall 114 which has a pair of co-planar end sections **114*aa* spaced from each other to define therebetween an opening 111 for access to the interior of the tray. Each of the end sections 114*aa* includes a pair of panels 114*a* which are foldably joined along fold lines 115 to the upper edges of related side walls 112** and which are folded over and secured to each other in overlapped relation to form a tubular structure.

The ends of the structure are closed by a pair of end walls 120 which are foldably joined at their lower edges along fold lines 121 to opposed end edges of bottom wall 110. End walls 120 are each provided with a pair of laterally spaced upwardly extending projections or lock tabs 126 which are adapted to be received within related top wall openings 127 to lock the tray in erected condition.

If desired, side walls 114 may be provided with longitudinally extending central located fold lines **112*a*** which permit the tubular structure to be collapsed in an alternate manner.

Also, end walls 120 may be provided with recesses or finger holes 129 to aid in grasping the tray blank when it is in inverted form to erect the tray by folding the end walls toward each other until the tabs 126 snap into place within related openings 127.

Turning to FIGS. 5–8, it will be seen that yet another modification is provided. In this modified form T″ is formed from a blank B″ of paperboard having a layer of film F″ secured thereto.

Tray T″ includes a bottom wall 210 having a pair of opposed side walls 212 foldably joined at their lower edges along fold lines 213 to opposed side edges of the bottom wall. Tray T″ also includes a top wall 214 having a pair of co-planar end sections 214*a* which are spaced from each other to provide therebetween an opening 211 for access to the tray.

Top wall end sections 214*a* are foldably joined along corresponding side edges on fold lines 215*a* to adjacent upper edges of one side wall 212 while the opposed side edges of end sections 214*a* are foldably joined along fold lines 215*b* to a glue flap 216 which may be adhesively secured to the other side wall 212 in a manner similar to that of the first described embodiment.

Again there is provided a pair of end walls 220 which are foldably joined at their lower edges on fold lines 221 to opposed end edges of bottom wall 210.

Each of the end walls 220 are provided with a pair of generally triangular wings 222 which are foldably joined on fold lines 223 to opposed side edges of end wall 220 and which have extending upwardly therefrom projections or lock tabs 226 adapted to be received within related openings 227 in the top wall end sections in the same manner as the previously described embodiment.

Figure 6:
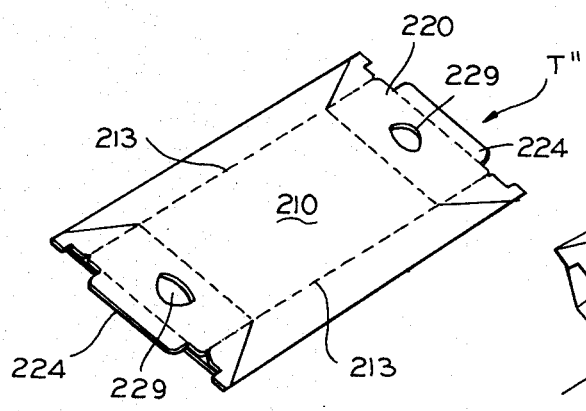
FIGS. 6 and 7 are perspective views of the tray of FIG. 5 but shown in an inverted position to illustrate the stages of erecting the tray.
Figure 7:
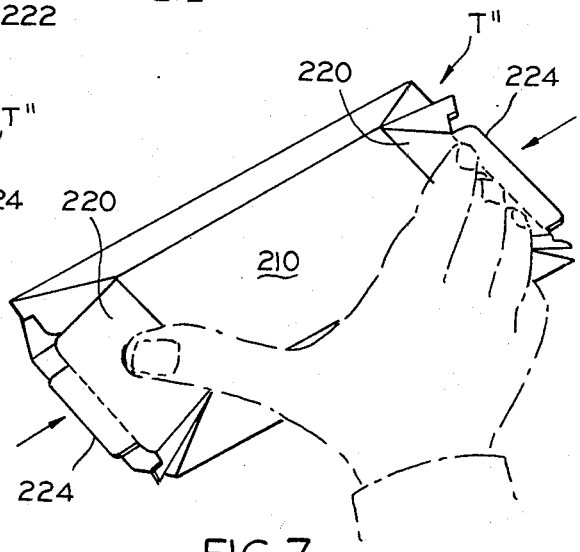
Figure 5:
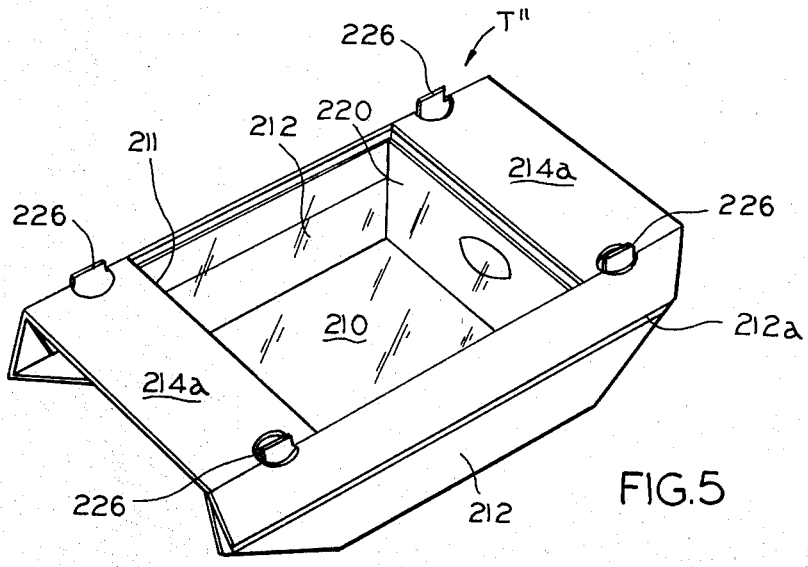
FIG. 5 is a view similar to FIG. 1, but illustrating yet another modified form of the invention.

Additionally, each of the end walls may be provided with an outboardly extending flange 224 which is foldably joined at its inboard edge along fold line 225 to the upper edge of the related end wall and which is disposed to lie against the lower surface of the related top wall end section 214*a*. Also, end walls 220 may be provided with finger openings 229 to facilitate grasping of the underside of the tray to snap it into erected condition with one hand as illustrated in FIGS. 6 and 7.

We claim:

1. A paperboard and film tray for holding liquid and readily erectable with one hand from a collapsed tubular blank, comprising:

(a) a bottom wall;

(b) a pair of opposed side walls foldably joined at their lower edges to and upstanding from opposed side edges of said bottom wall;

(c) a top wall foldably joined at opposed side edges to and extending laterally between upper edges of respective side walls;

(d) said top wall including a pair of co-planar end sections spaced from each other a distance not substantially less than the length of said bottom wall to form an opening therebetween for access to said tray;

(e) a pair of opposed end walls foldably joined at their lower edges to and extending upwardly from opposed end edges of said bottom wall;

(f) said end walls each having at least one upper portion engageable with an edge of an opening in said top wall to provide interlocking engagement between said end wall and said top wall;

(g) a relatively thin, flexible sheet of liquid impermeable material having marginal areas secured to certain of said side and end walls.

2. A tray according to claim 1, wherein at least portions of the side walls extend beyond the ends of said bottom wall and are co-extensive with said top wall.

3. A tray according to claim 1, wherein each of said top wall end sections includes a pair of panels secured to each other in overlapped relation.

4. A tray according to claim 1, wherein each of said end walls has a pair of laterally spaced projections extending upward adjacent the corners thereof for engagement within related openings in an adjacent top wall end section.

5. A tray according to claim 1, wherein each of said end walls has a pair of wings foldably joined to opposed side edges thereof and disposed against inside surfaces of said end walls outboardly of a related end wall.

6. A tray according to claim 1, wherein each of said end walls has a pair of wings foldably joined to opposed side edges thereof, and wherein said wings have projections extending upwardly for engagement within related openings in an adjacent top wall end section.

7. A tray according to claim 1, wherein each of said end walls has a flange foldably joined to and extending outboardly from an upper edge thereof and disposed against the underside of a related top wall end section.

8. A tray according to claim 1, wherein said side walls each have a longitudinally extending fold line located approximately midway between and parallel to the upper and lower edges thereof to facilitate collapsing and erecting of the tray.

* * * * *